United States Patent [19]

McGee

[11] 4,210,468

[45] Jul. 1, 1980

[54] PISTON PIN AND METHOD FOR MAKING SUCH

[75] Inventor: Sherwood W. McGee, Lisle, Ill.

[73] Assignee: Amsted Industries Incorporated, Chicago, Ill.

[21] Appl. No.: 934,337

[22] Filed: Aug. 17, 1978

[51] Int. Cl.[2] ..... C21D 9/08

[52] U.S. Cl. ..... 148/12.4; 148/39; 148/150

[58] Field of Search ..... 148/150, 12.4, 36, 39

[56] References Cited

U.S. PATENT DOCUMENTS 3,567,529 3/1971 Burtnett ..... 148/150

*Primary Examiner*—R. Dean

*Attorney, Agent, or Firm*—John L. Schmitt; Fred P. Kostka; Edward J. Brosius

[57] ABSTRACT

A piston or wrist pin for joining a pistonhead to a connecting rod commonly used in an internal combustion engine has an elongated hollow cylindrical configuration. The metal chosen for the pin may contain selective amounts of carbon, boron, nickel, chromium, vanadium and other alloying constituents to produce a metallurgical composition which may be selectively heat treated to provide a final structure having physical properties to meet a particular job requirement. The heat treating of the pin may be accomplished in a two step procedure which creates a pin having microstructural zones of residual stress having equal and opposite values.

5 Claims, 4 Drawing Figures

FIG. 1
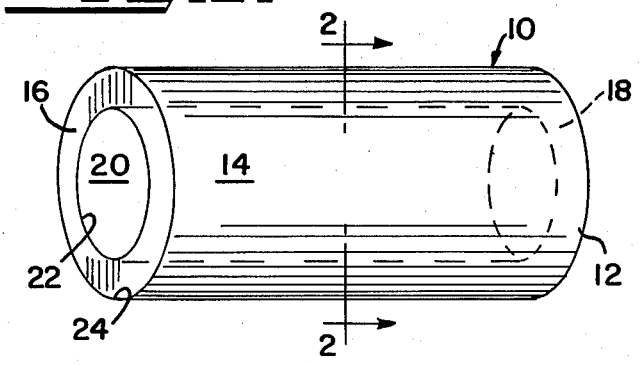
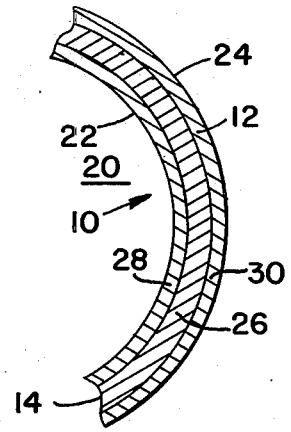
FIG. 2
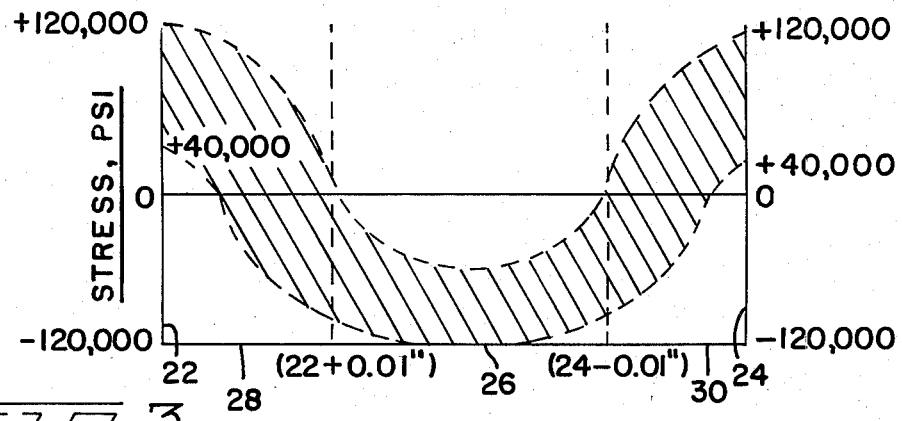
FIG. 3
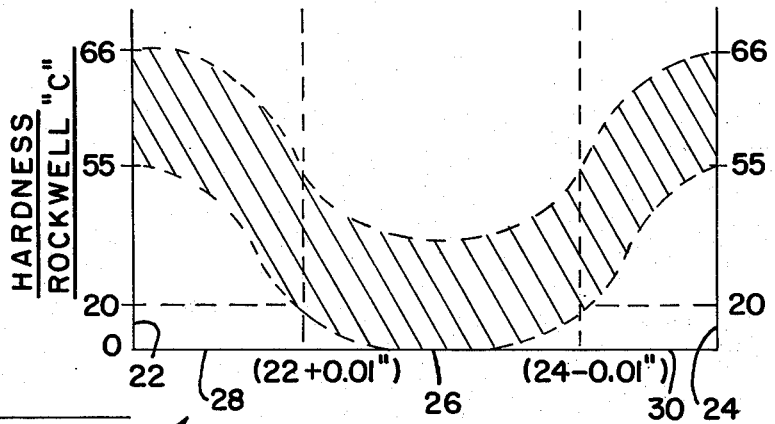
FIG. 4

PISTON PIN AND METHOD FOR MAKING SUCH

BACKGROUND OF THE INVENTION

1. Field of the Invention

This invention relates to piston or wrist pins for joining a pistonhead to a connecting rod of a piston and more particularly to piston pins having high performance characteristics to allow use with internal combustion engines. Further, this invention relates to a method of making this pin in an energy efficient manner.

2. Description of the Prior Art

Piston pins are in a well defined art and have been available for many years in various sizes and having various physical properties.

A piston pin is commonly used to pivotally join a pistonhead to a connecting rod of the piston for use in a positive displacement pump, an internal combustion engine or other such mechanical linkage converting linear movement to rotary movement or the reverse thereof.

U.S. Pat. No. 2,730,472 discloses a piston pin formed so that the pin has a hardened outer surface which is produced by heating the pin by induction coils. The interior of the pin remains sufficiently soft to allow a core or center opening to be subsequently formed therein. U.S. Pat. No. 2,604,419 discloses a hollow article formed by a similar method.

Another hollow piston pin with superior performance characteristics is made by carburizing the pins whereby the carbon content of the exterior surfaces is increased by placing the pin in a high carbon atmosphere to produce a hard exterior surface. The percentage carbon content of the surface of the pin may be increased to proximate 1.0% after a minimum 2–12 hour exposure.

Pins subjected to carburizing have several undesirable characteristics, however. Firstly, carburizing requires a high fossil fuel input. Secondly, the higher carbon content outer surface produces a pin having a reduced fatigue life.

As discussed in U.S. Pat. No. 3,216,869, improved fatigue life may be obtained by use of favorable residual stresses within a part. These residual stresses are achieved by producing a part having an outer zone which has a lower martensite forming temperature than an inner zone of the part. Where residual stresses are undesirable, the part may be "inverse hardened" as is discussed in U.S. Pat. No. 3,536,540.

SUMMARY OF THE INVENTION

Steel bar stock may be conveniently formed into piston pins having a hollow cylindrical body. This forming may be accomplished in a well known manner, as for example by drilling or extrusion of the bar stock in semi-annealed or fully annealed state.

After forming, the piston pin bodies are subjected to a series of heat treating steps which may include two heating and cooling procedures. The heating is preferably accomplished by electrical induction.

Upon completion of these heat treating steps, the pins have a microstructure comprising a thin inner and outer zone portion of hard martensite positioned on each side of a middle portion of tempered martensite. Further, the inner and outer zones have a selective residual compressive stress which is in equilibrium with the middle portion which has a selective residual tensile stress.

The pin and method for making such of this invention has several advantages over known piston pins.

Firstly, the manufacture of the piston pin requires sufficiently less energy, particularly heat from natural gas, than other known methods of manufacture.

Secondly, the piston pin of this invention has improved physical characteristics. More particularly, tensile strength, fatigue life and impact resistance have been increased. These improved characteristics are in part attributable to the alloy content which is constant throughout the pin body.

DESCRIPTION OF THE DRAWINGS

FIG. 1 is a perspective view of the piston or wrist pin of this invention.

FIG. 2 is a partial cross-sectional view of the pin of FIG. 1 as seen generally along the line 2—2.

FIG. 3 is a graph relating values of residual stresses within the pin to a cross-sectional thickness of the pin.

FIG. 4 is a graph relating values of hardness within the pin to the cross-sectional thickness of the pin.

DESCRIPTION OF THE PREFERRED EMBODIMENT

A pin of this invention is shown generally in FIG. 1 and designated 10. The pin 10 has an elongated body 12 of a cylindrical configuration. The body 12 includes a sidewall 14, end walls 16, 18 and an inner cylindrical-shaped aperture 20. The sidewall 14 is further defined by an inner surface 22 and an outer surface 24.

As was noted earlier, the pin body 12 may be formed by machining the aperture 20 in a piece of bar stock. Then the bar stock may be cut to a desired length by use of a cut off tool. The hardness of the bar stock should not exceed Rockwell "C" 40.

Where the pin body 12 is to be formed by cold extruding a steel blank, the blank of predetermined mass of steel is placed in a die closed by a bottom knockout punch. A forming punch within a guide punch contacts a top surface of the blank to cause a plastic flow of material about the forming punch to produce the aperture 20. Since the travel of the forming punch is limited, the extruded blank has a closed end which may be reopened by either punching or machining. A suggested maximum hardness for the steel blank is Rockwell 20C.

The desired material for the pin body 12 may be medium carbon content steel such as SAE 1045 having proximately 0.65% manganese or a low alloy carbon steel such as SAE 15B35 containing proximately 0.0008% boron and 0.32% carbon. The percentage range of other alloying constituents which may be present is as follows:

| Constituent | Percentage Range by Weight |
|---|---|
| Carbon | 0.25 - .60 |
| Boron | .0001 - .025 |
| Manganese | .05 - 0.95 |
| Nickel | .05 - 2.0 |
| Chromium | .05 - 1.5 |
| Molybdenum | .02 - .5 |
| Vanadium | .02 - .5 |
| Cobalt | .02 - 1.5 |
| Copper | .0.2 - 1.5 |
| Tungsten | .001 - 1.5 |
| Sulfur | .005 - .6 |
| Selenium | .0005 - .3 |

-continued

| Constituent | Percentage Range by Weight |
|---|---|
| Phosphorous | .001 - .2 |
| Lead | .0005 - .5 |
| Tellurium | .0005 - .3 |
| Nitrogen | .5 maximum |
| Oxygen | .1 maximum |
| Iron | Balance |

Once the pin body 12 has been formed, it may be initially hardened by induction heating the pin body 12 to a temperature above its critical temperature and in a range of 1425 to 1625° F. This induction heating may be accomplished by exposing the pin body 12 for 90 to 180 seconds to a flux of an induction coil operated at 10,000 cycles/sec to provide proximately 2.5 kilowatt hours of energy per pound of pin body material.

To prevent oxidation of the inner surface 22, end walls 16, 18 and the outer surface 24 of the pin body 12, these surfaces may be conveniently coated with light oil-carbon dust mixture.

The heated pin body 12 is then quenched to produce a rapid temperature drop through the critical temperature such that the pin body 12 has a metallurgical structure comprising at least 90% martensite. This quenching may be accomplished by submersion of the pin body 12 in an 8% brine solution maintained at a near constant temperature and agitated to insure turbulent contact with the surfaces 22, 24 of the pin body 12.

When the temperature of the pin body 12 has dropped to proximately 400° F., the pin body 12 may be removed from the brine bath and conveniently fed through another induction coil operated at from 10,000 to 200,000 cycles per second to provide proximately 2.5 kilowatts of energy per square inch of the outer surface 24 of the pin body 12. The purpose of this second heating is to temper a middle core portion 26 of the pin sidewall 14.

Pins are fed through this second induction heater at a rate such that a temperature of an inner zone 28 of the sidewall 14 having a thickness proximating 0.02 to 0.10 inch adjacent to the inner surface 22 does not exceed 325° F.

At the same time, an outer zone 30 of the sidewall 14 having a like proximate thickness is heated to a temperature range of 1425° to 1650° F. while the middle core portion 26 has a temperature gradient between these high and low ranges. A cooling media such as the quenching solution noted before may be sprayed into the aperture 20 and onto the inner surface 22 to maintain this desired temperature gradient.

Immediately after the pin body 12 has been heated as noted above, the body is again quenched by spraying the outer surface 24 with a quenching solution.

This procedure of heating the outer surface 24 of pin body 12 followed by an immediate quenching while at the same time maintaining a temperature gradient between the outer surface 24 and the inner surface 22 as noted, produces a fine grained metallurgical microstructure wherein the inner portion 28 and outer zone 30 remain hard martensite. The middle core portion 28 in turn is now tempered martensite and may contain soft ferrite and cementite. Note that the outer zone 30 of the pin body 12 remains of hard martensite because this portion is brought to a temperature above the critical temperature while the middle core portion 28 remains below the critical temperature.

The mechanical properties of the pin 10 may be further enhanced by tempering the pin body 12 in a temperature range of 300° to 450° F. followed by refrigeration at −100 to −300° F. The pin body 12 also may be ground and lapped to reduce dimensional tolerance which also improves mechanical properties.

To further appreciate the mechanical properties of the pin 10, reference should be made to FIG. 3 where the residual stress of the pin body 12 is shown. The vertical axis of the graph of FIG. 3 represents a value of residual stress as measured in units of pounds per square inch. The residual stresses represented by the vertical axis may be in compression as represented by positive or "+" units or in tension as represented by negative or "−" units. The horizontal axis represents the distance between the inner surface 22 and outer surface 24 of the pin body 12. As seen in FIG. 3, the magnitude and type of stress, i.e. compression or tension, within the sidewall 14 varies between the inner surface 22 and outer surface 24. Total wall thickness is a design criteria dependent upon final pin use.

Depending on the exact amounts and types of alloying constituents in the pin body 12, the inner zone 28 and the outer zone 30 will be of a compressive state and have a thickness in the range of 0.005 to 0.01 inch. The tempering temperature determines to a large degree the maximum compressive stress. The maximum compressive stress occurs at the inner and outer surfaces 22, 24 and may proximate 120,000 psi.

FIG. 4 shows variations in hardness across the sidewall 14 of the body 12 of the pin 10. The vertical axis represents values of hardness in units of Rockwell C while the horizontal axis is the same as in FIG. 3 and depicts the distance between the inner surface 22 and outer surface 24 of the pin body 14.

As seen in FIGS. 3 and 4, where the hardness of the inner and outer zones 28, 30 is only Rockwell C 55, the compressive stress at the inner and outer surfaces 22, 24 may proximate 40,000 psi.

Maximum hardness occurs at the inner and outer surfaces 22, 24 of the pin body 12 and may vary between 66 and 55 Rockwell C. At a point proximately 0.01 inch from the surface 22, 24, the value of hardness may vary between 55 and 20 Rockwell C. As would be expected, the middle core portion 28 comprising primarily tempered martensite has a low hardness value while the inner and outer zones 28, 30 comprising primarily hard martensite have a high hardness value.

This high surface hardness and the distribution of residual stresses gives the piston pin 10 superior mechanical properties and this pin 10 has been produced without an excessive consumption of fossil fuels.

While various modifications may be suggested by those versed in the art, it should be understood that I wish to embody within the scope of the patent warranted hereon, all such modifications as reasonably and properly come within the scope of my contribution to the art.

What is claimed is:

1. A method of making a piston pin rod particularly adapted for use in an internal combustion engine, said method comprising the steps of:

(1) forming a steel bar stock having a uniformly distributed carbon content beig in a range by weight of 0.25 to 0.6 % into a piston pin having an elongated cylindrical body with a center aperture and with an annular wall of a predetermined wall thickness, said annular wall extending between spaced end walls, (2) heating said body to a temperature above the critical temperature of said steel with a first heating means to produce a uniform austenitic microstructure within said annular wall, (3) cooling said body to a temperature below said critical temperature at a rate so as to produce a microstructure of hard martensite throughout said annular wall, (4) applying induction heating along an outer surface of said annular wall to provide zones at different temperatures within said annular wall comprising a thin outer annular zone having a temperature above said critical temperature, a thin inner annular zone having a temperature not exceeding 325° F. and a central zone intermediate said inner and outer zones and having a temperature gradient between said temperatures of said inner and outer zones and less than said critical temperature, and (5) cooling said body so as to produce a microstructure of hard martensite in a high compressive stress state in said inner and outer zones including said end walls, and a microstructure of tempered martensite in a tensile stress state in said central zone with said carbon content remaining substantially uniform throughout, wherein said piston pin has improved tensile strength, fatigue life and impact resistance.

2. A piston pin particularly adapted for joining a pistonhead to a connecting rod, said pin comprising, a body of a ferrous material having a carbon content in a range by weight of 0.25 to 0.6%, said carbon content being substantially uniformly distributed throughout said body, said body being elongated and cylindrical with a center aperture therethrough and further defined by a sidewall terminating at an inner and outer surface, said inner and outer surfaces extending between spaced end walls, said sidewall divided into an inner zone and an outer zone adjacent to said inner surface and said outer surface respectively and a center core portion between said inner and outer zones, said inner and outer zones including said end walls comprising hardened martensite in a high compressive stress state and said center core portion of a tempered martensite in a tensile stress state, wherein said piston pin has high performance characteristics so as to be usable in an internal combustion engine.

3. A piston pin as defined by claim 2 and further characterized by, said inner and outer surfaces and said end walls having a high hardness value in a range of about 55 to 66 Rockwell C, said hardness value decreasing within said inner and outer zones with said middle core portion having a lower hardness value proximating 25 Rockwell C.

4. A piston pin as defined by claim 2 and further characterized by, said high compressive stress value in said inner and outer surfaces decreasing within said zones to approach a nominal value at an adjacency of said inner and outer zones and said center core portion respectively.

5. A piston pin comprising, an elongated cylindrical body made of a steel having uniformly distributed carbon content in a range by weight of 0.25 to 0.6% and other alloying constituents selected from a group including:

| Constituent | Percentage Range by Weight |
|---|---|
| Boron | .0001 - .025 |
| Manganese | .05 - 0.95 |
| Nickel | .05 - 2.0 |
| Chromium | .05 - 1.5 |
| Molybdenum | .02 - .5 |
| Vanadium | .02 - .5 |
| Cobalt | .02 - 1.5 |
| Copper | .02 - 1.5 |
| Tungsten | .001 - 1.5 |
| Sulfur | .005 - .6 |
| Selenium | .0005 - .3 |
| Phosphorous | .001 - .2 |
| Lead | .0005 - .5 |
| Tellurium | .0005 - .3 |
| Nitrogen | .5 maximum |

said pin body including end walls, an elongated circular aperture intersecting said end walls and a sidewall formed between an outer surface of said pin body and an inner surface defining said aperture, said sidewall comprising, a thin circular outer zone formed adjacent to said outer surface, a thin circular inner zone formed adjacent to said inner surface, said zones being in a high compressive stress state and formed of a hardened martensite to have a selectively high hardness value, and a circular center core portion positioned between said inner and outer zones, said portion being in a tensional stress state and formed of a tempered martensite to have a selectively lower hardness value, wherein said pin has superior surface hardness and fatigue life characteristics.

* * * * *